US006539735B1

(12) United States Patent
Schmidt

(10) Patent No.: US 6,539,735 B1
(45) Date of Patent: Apr. 1, 2003

(54) REFRIGERANT EXPANSION TANK

(75) Inventor: Douglas A. Schmidt, Marietta, OH (US)

(73) Assignee: Thermo Forma Inc., Marietta, OH (US)

( * ) Notice: Subject to any disclaimer, the term of this patent is extended or adjusted under 35 U.S.C. 154(b) by 0 days.

(21) Appl. No.: 10/005,568

(22) Filed: Dec. 3, 2001

(51) Int. Cl.[7] ..... F25B 41/00; F25B 45/00
(52) U.S. Cl. ..... 62/174; 62/149
(58) Field of Search ..... 62/174, 149, 503, 62/158, 217

(56) References Cited

U.S. PATENT DOCUMENTS

| | | | | |
|---|---|---|---|---|
| 3,214,932 | A | 11/1965 | Grant | 62/174 |
| 3,736,763 | A | 6/1973 | Garland | 62/85 |
| 4,096,706 | A | 6/1978 | Beckwith | 62/115 |
| 4,223,537 | A | 9/1980 | Sanborn et al. | 62/174 |
| 4,484,452 | A | 11/1984 | Houser, Jr. | 62/174 |
| 4,546,616 | A | 10/1985 | Drucker | 62/174 |
| 4,593,752 | A | 6/1986 | Tipton | 165/48.1 |
| 5,050,393 | A | 9/1991 | Bryant | 62/115 |
| 5,070,705 | A | 12/1991 | Goodson et al. | 62/197 |
| 5,335,511 | A | 8/1994 | McKeown | 62/174 |
| 5,372,013 | A | 12/1994 | Lau et al. | 62/174 |
| 5,477,697 | A | 12/1995 | Wharton et al. | 62/117 |
| 5,481,883 | A | 1/1996 | Harkness, Jr. et al. | 62/77 |
| 5,784,892 | A | 7/1998 | Reedy | 62/174 |
| 5,799,497 | A | 9/1998 | Sano et al. | 62/149 |
| 5,865,038 | A | 2/1999 | Maxwell | 62/474 |
| 5,937,660 | A | 8/1999 | Lau et al. | 62/174 |
| 6,112,532 | A | 9/2000 | Bakken | 62/174 |
| 6,134,899 | A | 10/2000 | Brown et al. | 62/195 |
| 6,209,338 | B1 | 4/2001 | Thatcher, Jr. | 62/292 |
| 2002/0017106 | A1 * | 2/2002 | Flynn et al. | 62/156 |
| 2002/0035841 | A1 * | 3/2002 | Flynn | 62/217 |
| 2002/0040584 | A1 * | 4/2002 | Podtchereniaev et al. | 62/114 |

* cited by examiner

*Primary Examiner*—Denise L. Esquivel
*Assistant Examiner*—Marc Norman
(74) *Attorney, Agent, or Firm*—Wood, Herron & Evans, LLP

(57) ABSTRACT

A refrigeration system generally including a compressor, a condenser, an expansion device, and an evaporator. A refrigerant expansion tank is connected to the suction side of the compressor to vary the charge of refrigerant in the refrigeration system. Preferably, the expansion tank adds additional refrigerant to the system only after it has reached, is near, or at least is approaching, its operating point. The additional refrigerant is removed from the refrigerant fluid path and contained within the expansion tank when the refrigeration system is turned off.

14 Claims, 4 Drawing Sheets

REFRIGERANT EXPANSION TANK

FIELD OF THE INVENTION

The present invention relates generally to the field of refrigeration systems and, more particularly, to a refrigeration system having a variable refrigerant charge.

BACKGROUND OF THE INVENTION

Refrigeration systems generally include a compressor, condenser, expansion device and evaporator that are interconnected by a refrigerant fluid path. The compressor draws low pressure refrigerant gas through a suction line, compresses the low pressure refrigerant gas and then discharges it as a high pressure refrigerant gas into the high pressure side of the system. The high pressure refrigerant gas is cooled and liquified in the condenser and is discharged from the condenser as a high pressure liquid refrigerant. At the expansion device, the high pressure liquid refrigerant expands into a low pressure liquid refrigerant before entering the evaporator. The evaporator cools the refrigerated space of, for example, a freezer, by means of a cold wall of the freezer's cabinet. Alternatively, room air may be directed across the evaporator coil by fans to cool the air before it enters the intended refrigerated space. The evaporator evaporates the low pressure liquid refrigerant and discharges a low pressure gaseous refrigerant into the suction line of the compressor and the cycle repeats.

The charge of refrigerant circulating within the refrigeration system is determined by several factors, including the desired cooling capacity of the system and the operating constraints of the refrigeration or heat exchange components of the system, particularly the compressor. For many applications, the desired charge of refrigerant is well within the operating capability of the compressor through the range of temperatures expected to be encountered so that the compressor does not place an operating constraint on the charge of refrigerant that can be used in the system to provide the desired cooling capacity.

However, for some refrigeration systems, such as ultra low temperature freezers that must be cooled from ambient to an operating point in the range of about −50° C. to about −90° C., the compressor places an operating constraint on the charge of refrigerant that may be used at elevated temperatures, so that the cooling capacity of the freezer at its operating point must be sacrificed. While additional charge of refrigerant may be desired for providing additional cooling capacity to the freezer at its operating point, the compressor is not capable of handing the additional refrigerant in the fluid path at elevated temperatures of the system without risking damage to the compressor.

Therefore, there is a need for a refrigeration system that safely and reliably operates to provide additional cooling capacity to the system at its operating point without risking damage to the refrigeration or heat exchange components of the system as it cools down from ambient to its operating point.

SUMMARY OF THE INVENTION

The present invention overcomes the foregoing and other shortcomings and drawbacks of refrigeration systems heretofore known.

While the invention will be described in connection with certain embodiments, it will be understood that the invention is not limited to these embodiments. On the contrary, the invention includes all alternatives, modifications and equivalents as may be included within the spirit and scope of the present invention.

A refrigeration system in accordance with the principles of the present invention includes a compressor, condenser, expansion device and evaporator that are interconnected by a refrigerant fluid path. A refrigerant expansion tank is provided in the system for varying the charge of refrigerant in the fluid path. Varying the charge of refrigerant in the system is particularly advantageous when additional cooling capacity to the system is desired at its operating point, but the operating constraints of the refrigeration or heat exchange components of the system, particularly the compressor, prevent the presence of additional refrigerant in the fluid path of the system while it operates at elevated temperatures before cooling down to its operating point.

In accordance with the principles of the present invention, the expansion tank adds additional refrigerant to the system only after it has reached, is near, or at least is approaching, its operating point. In this way, the operating constraints of the compressor that occur at elevated temperatures of the system are no longer present, and the compressor is therefore capable of handling the additional refrigerant at the lower temperatures of the system to provide the additional cooling capacity. The additional refrigerant is removed from the fluid path and contained within the expansion tank when the refrigeration system is turned off, and is ready to be added again to the system to provide the additional cooling capacity.

The expansion tank is connected to a suction line of the compressor through a valve and an expansion device, such as a capillary tube expansion device. The valve is a solenoid-controlled valve and includes a normally-open solenoid for controlling open and closed positions of the valve. When the valve is open, a predetermined amount of refrigerant stored in the expansion tank passes through the capillary tube expansion device to the suction side of the compressor. The capillary tube expansion device meters the flow of refrigerant from the expansion tank to the compressor to prevent damage to the compressor. The additional refrigerant provided by the expansion tank increases the charge of refrigerant in the refrigerant fluid path of the system to thereby provide additional cooling capacity to the system. The valve also permits the refrigerant to pass from the suction line back to the expansion tank so that when the valve is closed, a predetermined amount of the refrigerant is stored in the expansion tank and ready to be added again to the suction line of the system.

In accordance with one aspect of the present invention, the solenoid of the valve is controlled by a time-delay relay. When the refrigeration system is turned on, the contacts of the time-delay relay close to cause the solenoid-controlled valve to close. At this point, refrigerant contained within the expansion tank is stored until the valve is opened again.

After power has been applied to the refrigeration system, the system begins to cool down to its operating point. The relay contacts of the time-delay relay remain closed for a predetermined duration of time, such as eight (8) hours for example, to allow sufficient time for the system to reach its operating point. The solenoid-controlled valve remains closed as long as the relay contacts of the time-delay relay remain closed. When the predetermined duration of time expires, the time-delay relay opens its relay contacts which causes the solenoid-controlled valve to open. At this point, the refrigeration system is operating preferably at or near, or at least approaching, its operating point and refrigerant stored in the expansion tank is now permitted to pass from the expansion tank, through the valve and capillary tube expansion device, to the suction line of the compressor to thereby provide additional cooling capacity to the system.

When the refrigeration system is turned off, the relay contacts of time-delay relay remain open, and the solenoid-controlled valve remains open as well. In this way, refrigerant is permitted to pass from the suction line of the compressor back to the expansion tank so that when the valve is closed, a predetermined amount of the refrigerant is stored in the expansion tank and ready to be added again to the suction line of the system. The valve closes when the refrigeration system is turned on again which causes the relay contacts of the time-delay relay to close for the predetermined duration of time and the cycle repeats.

In accordance with another aspect of the present invention, the solenoid of valve is controlled by a relay that is operatively coupled to a relay control and a temperature probe. In this embodiment, the temperature probe is preferably mounted in a cabinet of the refrigeration system or other intended refrigerated space of the system.

When the refrigeration system is turned on, the contacts of the relay close to cause the solenoid-controlled valve to close. At this point, refrigerant contained within the expansion tank is stored until the valve is opened again.

After power has been applied to the refrigeration system, the system begins to cool down to its operating point. During this time, the relay control, which may comprise a microprocessor or other controller coupled to a relay driver by way of example, continuously or intermittently monitors the temperature sensed by the temperature probe. The relay contacts of the relay remain closed until the relay control determines that the cabinet or other portion of the refrigeration system has reached a predetermined temperature as sensed by the temperature probe. The solenoid-controlled valve remains closed as long as the relay contacts of the relay remain closed.

When the relay control determines that the cabinet or other portion of the refrigeration system has reached a predetermined temperature as sensed by the temperature probe, the relay control causes the relay to open its relay contacts which causes the solenoid-controlled valve to open. At this point, the refrigeration system is operating preferably at or near, or at least approaching, its operating point and refrigerant stored in the expansion tank is now permitted to pass from the expansion tank, through the valve and capillary tube expansion device, to the suction line of the compressor to thereby provide additional cooling capacity to the system.

When the refrigeration system is turned off, the relay contacts of relay remain open, and the solenoid-controlled valve remains open as well. In this way, refrigerant is permitted to pass from the suction line of the compressor back to the expansion tank so that when the valve is closed, a predetermined amount of the refrigerant is stored in the expansion tank and ready to be added again to the suction line of system. The valve closes when the refrigeration system is turned on again which causes the relay contacts of the relay to close until the predetermined temperature condition is met again and the cycle repeats.

The refrigerant expansion tank of the present invention varies the charge of refrigerant in the system to provide additional cooling capacity to the system when it has reached, is near, or at least is approaching, its operating point. In this way, the operating constraints of the compressor that occur at elevated temperatures of the system are no longer present, and the compressor is therefore capable of handling the additional refrigerant at the lower temperatures of the system to provide the additional cooling capacity. The additional refrigerant is removed from the fluid path and contained within the expansion tank when the refrigeration system is turned off, and is ready to be added again to the suction lines of the system to provide the additional cooling capacity in accordance with the principles of the present invention.

BRIEF DESCRIPTION OF THE DRAWINGS

The accompanying drawings illustrate embodiments of the invention, together with a general description of the invention given above, and the detailed description of the embodiments given below, serve to explain the principles of the invention.

DETAILED DESCRIPTION OF THE PREFERRED EMBODIMENT

Figure 1:
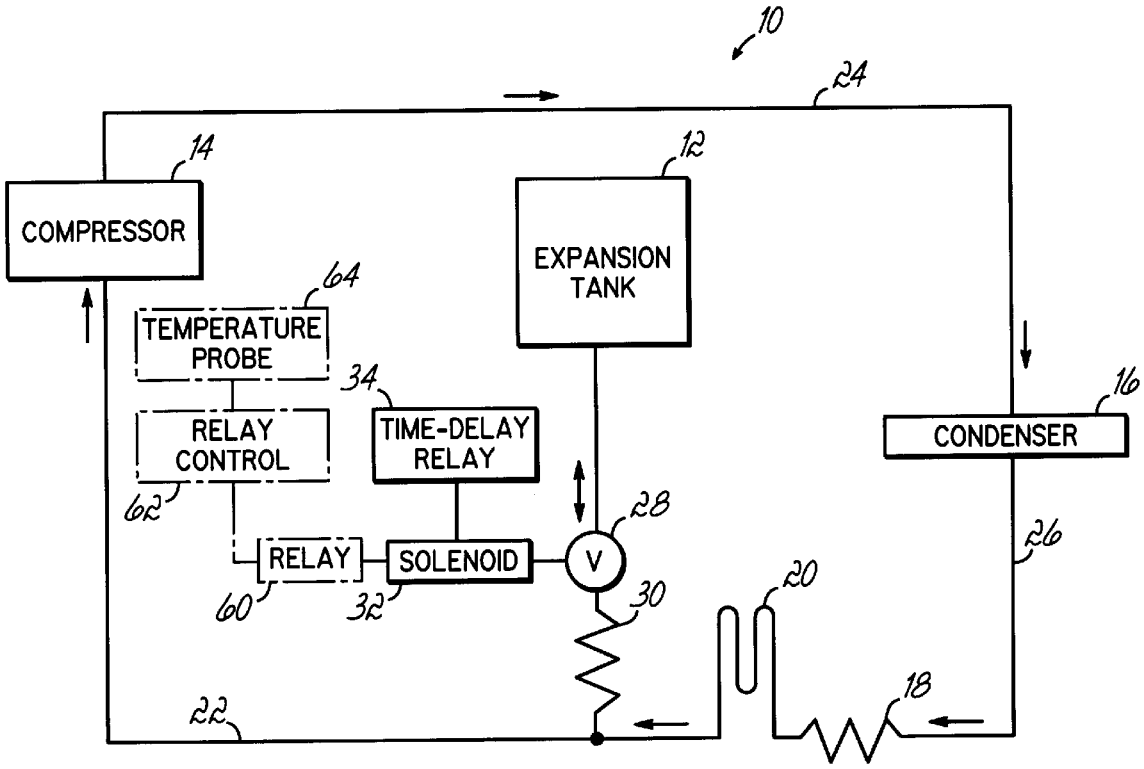
FIG. 1 is a block diagram of a single stage refrigeration system incorporating a refrigerant expansion tank in accordance with the principles of the present invention for varying the refrigerant charge in the single stage system.

Referring to FIG. 1, a basic system diagram of a single stage refrigeration system 10 is illustrated and includes a refrigerant expansion tank 12 in accordance with the principles of the present invention. It will be readily appreciated that only the main components of system 10 have been shown for clarity and that further standard components such as fans, valves, etc., would be added to the system, as necessitated by particular applications. Refrigeration system 10 generally comprises standard refrigeration or heat exchange components including a compressor 14, condenser 16, expansion device 18 and evaporator 20. Compressor 14 is driven by a conventional electric motor (not shown) and operates to draw low pressure refrigerant gas through suction line 22, compress the low pressure refrigerant gas and then discharge it as a high pressure refrigerant gas into the high pressure side of system 10, specifically into compressor discharge line 24. The high pressure refrigerant gas is cooled and liquified in condenser 16 and is discharged into condenser discharge line 26 as a high pressure liquid refrigerant leading to expansion device 18. Expansion device 18 is preferably a capillary tube allowing the high pressure liquid refrigerant to expand into a low pressure liquid refrigerant before entering the evaporator 20. In a conventional manner, evaporator 20 cools the refrigerated space of, for example, a freezer by means of a cold wall (not shown) of the freezer's cabinet (not shown). Alternatively, room air may be directed across the evaporator coil by way of one or more fans (not shown) to cool the air before it enters the intended refrigerated space. The evaporator 20 evaporates the low pressure liquid refrigerant and discharges a low pressure gaseous refrigerant into suction line 22 and the cycle repeats.

In accordance with the principles of the present invention, refrigerant expansion tank 12 is provided in system 10 for varying the charge of refrigerant in the refrigerant fluid path defined by suction line 22, compressor discharge line 24 and condenser discharge line 26. Varying the charge of refrigerant in the system 10 is particularly advantageous when additional cooling capacity to the system 10 is desired at its operating point, but the operating constraints of the refrigeration or heat exchange components of the system 10, particularly the compressor 14, prevent the presence of additional refrigerant in the fluid path of the system 10 while it operates at elevated temperatures before cooling down to its operating point. As will be described in greater detail below, expansion tank 12 adds additional refrigerant to the system 10 only after it has reached, is near, or at least is approaching, its operating point. In this way, the operating constraints of the compressor 14 that occur at elevated temperatures of the system 10 are no longer present, and the compressor 14 is therefore capable of handling the additional refrigerant at the lower temperatures of the system 10 to provide the additional cooling capacity. The additional refrigerant is removed from the fluid path and contained within the expansion tank 12 when the refrigeration system 10 is turned off.

Further referring to FIG. 1, expansion tank 12 is connected to the suction line 22 through a valve 28 and an expansion device, such as a capillary tube expansion device 30. In one embodiment, valve 28 is a solenoid-controlled valve and includes a normally-open solenoid 32 for controlling open and closed positions of the valve 28. One suitable solenoid-controlled valve 28 for use in the present invention is commercially available from Parker of Madison, Mo. and is sold as Model No. ORB1E2, although other suitable solenoid-controlled valves are possible as well. Of course, other valve structures are possible as well without departing from the spirit and scope of the present invention. When the valve 28 is open, a predetermined amount of refrigerant stored in the expansion tank 12 passes through the capillary tube expansion device 30 to the suction side of the compressor 14. The capillary tube expansion device 30 meters the flow of refrigerant from the expansion tank 12 to the compressor 14 to prevent damage to the compressor 14. The additional refrigerant provided by the expansion tank 12 increases the charge of refrigerant in the refrigerant fluid path of system 10 to thereby provide additional cooling capacity to the system 10. As will be described in detail below, the valve 28 also permits the refrigerant to pass from the suction line 22 back to the expansion tank 12 so that when the valve 28 is closed, a predetermined amount of the refrigerant is stored in the expansion tank 12 and ready to be added again to the suction line 22 of system 10 as described in detail below. In one embodiment of the present invention, the expansion tank 12 has a volume of about 200 $in^3$ to store about 6 oz of additional refrigerant when the refrigerant charge in the refrigerant fluid path at ambient temperature of system 10 is about 13 oz. Of course, the volume of expansion tank 12, the charge of refrigerant in the refrigerant fluid path at ambient and the amount of additional refrigerant added by expansion tank 12 will vary for particular applications as will be appreciated by those of ordinary skill in the art.

Figure 3A:
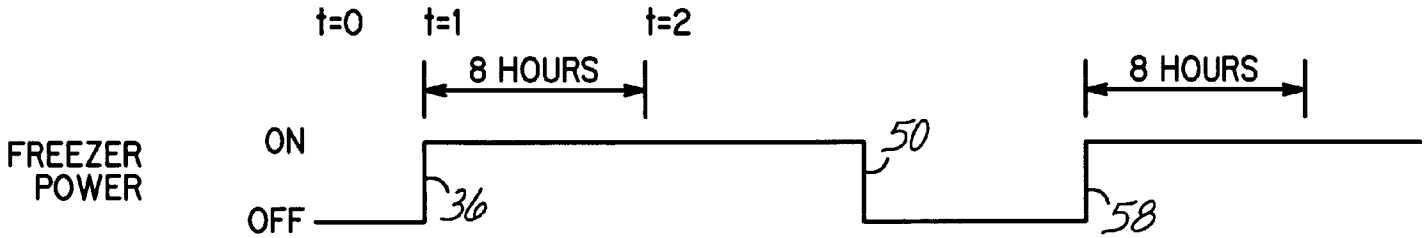
FIGS. 3A–3C are graphs illustrating control of the refrigerant expansion tank in accordance with one embodiment of the present invention.
Figure 3B:
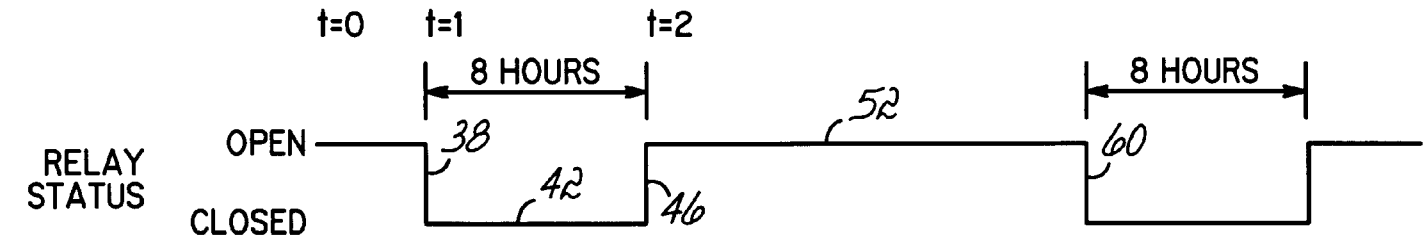
Figure 3C:
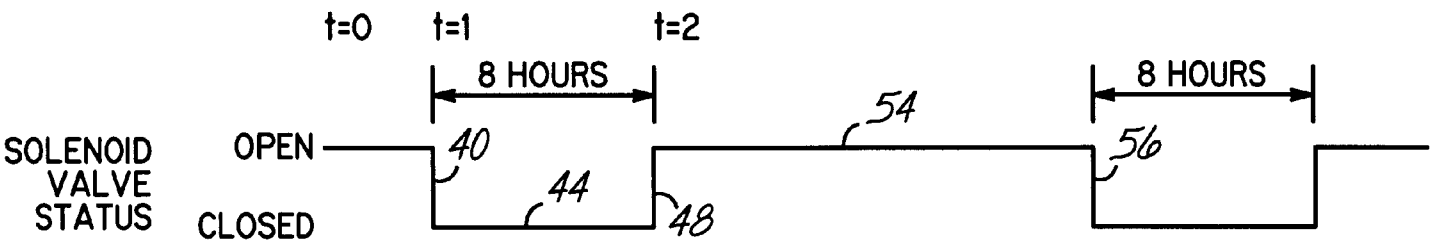

Referring to FIGS. 1 and 3A–3B, and in accordance with one aspect of the present invention, the solenoid 32 of valve 28 is controlled by a time-delay relay 34. One suitable time-delay relay 34 for use in the present invention is commercially available from Airotronics of Cazenovia, N.Y. and is sold as Model No. TGL208HC2H, although other suitable time-delay relays are possible as well. As shown in FIGS. 3A–3B, when the refrigeration system 10 is turned on at 36 (FIG. 3A), the contacts of time-delay relay 34 close at 38 (FIG. 3B) to cause the solenoid-controlled valve 28 to close at 40 (FIG. 3C). At this point, refrigerant contained within the expansion tank 12 is stored until the valve 28 is opened again.

After power has been applied to the refrigeration system 10 at 36 (FIG. 3A), the system 10 begins to cool down to its operating point. The relay contacts of the time-delay relay 34 remain closed for a predetermined duration of time, such as eight (8) hours for example as indicated at 42 (FIG. 3B), to allow sufficient time for the system 10 to reach its operating point. Of course, the amount of time necessary for the refrigeration system 10 to reach its operating point will vary for a particular application, and the time-delay relay 34 can be adjusted accordingly. As indicated at 44 (FIG. 3C), the solenoid-controlled valve 28 remains closed as long as the relay contacts of the time-delay relay 34 remain closed as indicated at 42 (FIG. 3B). When the predetermined duration of time expires, as indicated at 46 (FIG. 3B), the time-delay relay 34 opens its relay contacts which causes the solenoid-controlled valve 28 to open as indicated at 48 (FIG. 3C). At this point, the refrigeration system 10 is operating preferably at or near, or at least approaching, its operating point and refrigerant stored in the expansion tank 12 is now permitted to pass from the expansion tank 12, through the valve 28 and capillary tube expansion device 30, to the suction line 22 to thereby provide additional cooling capacity to the system 10.

Further referring to FIGS. 1 and 3A–3B, when the refrigeration system 10 is turned off at 50 (FIG. 3A), the relay contacts of time-delay relay 34 remain open as indicated at 52 (FIG. 3B), and the solenoid-controlled valve 28 remains open as well as indicated at 54 (FIG. 3C). In this way, refrigerant is permitted to pass from the suction line 22 back to the expansion tank 12 so that when the valve 28 is closed, as indicated at 56 (FIG. 3C), a predetermined amount of the refrigerant is stored in the expansion tank 12 and ready to be added again to the suction line 22 of system 10 as described in detail above. The valve 28 closes at 56 (FIG. 3C) when the refrigeration system 10 is turned on again at 58 (FIG. 3A) which causes the relay contacts of the time-delay relay 34 to close at 60 (FIG. 3B) for the predetermined duration of time and the cycle repeats as described in detail above.

Referring now to FIGS. 1 and 4A–4D, and in accordance with another aspect of the present invention, the solenoid 32 of valve 28 is controlled by a relay 60 that is operatively coupled to a relay control 62 and a temperature probe 64 (all shown in phantom in FIG. 1). In this embodiment, the temperature probe 64 is preferably mounted in a cabinet (not shown) of the refrigeration system 10 or other intended refrigerated space of the system 10.

Figures 4A, 4B, 4C, 4D:
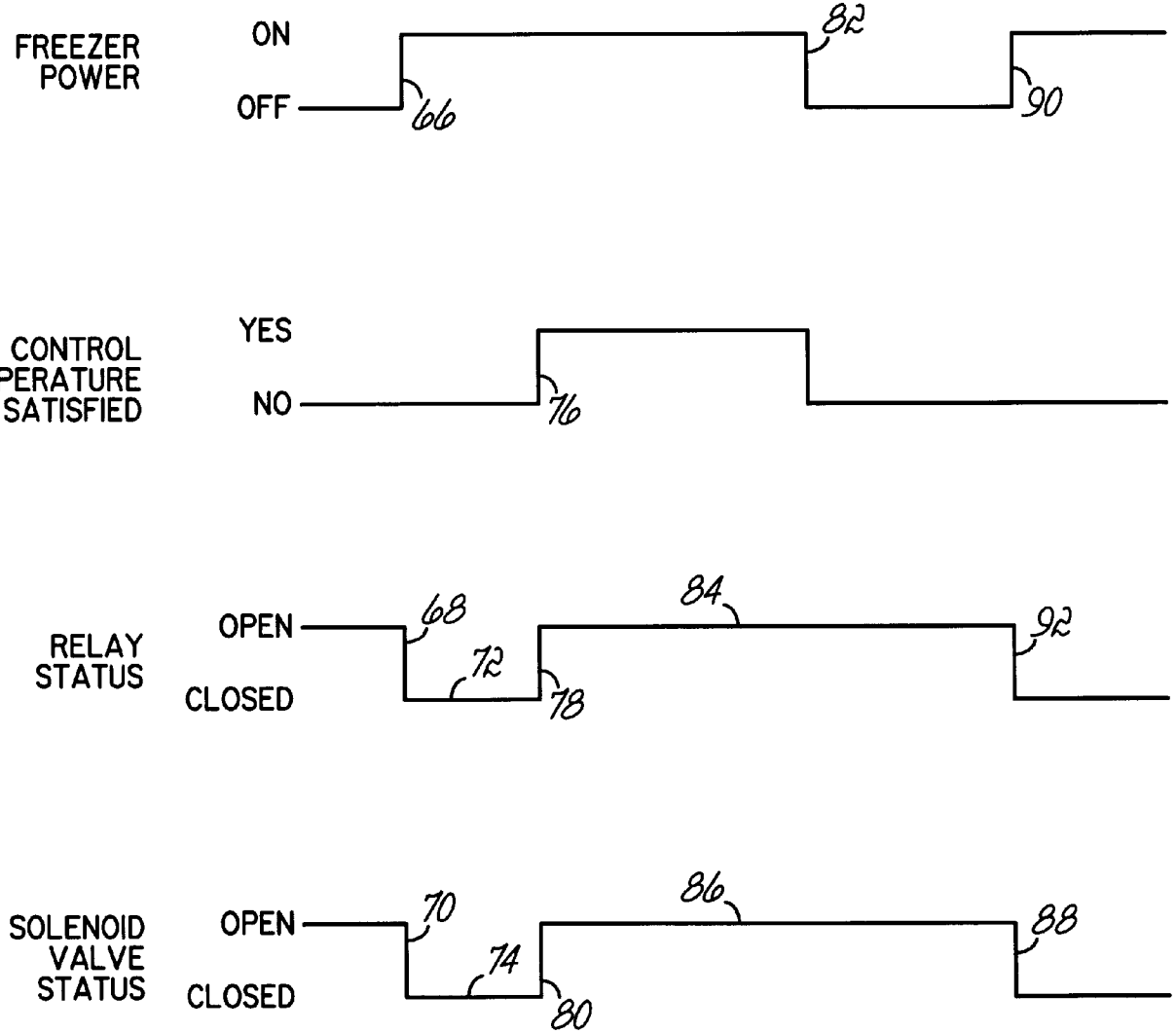
FIGS. 4A–4D are graphs illustrating control of the refrigerant expansion tank in accordance with an alternative embodiment of the present invention.

As shown in FIGS. 4A–4D, when the refrigeration system 10 is turned on at 66 (FIG. 4A), the contacts of relay 60 close at 68 (FIG. 4C) to cause the solenoid-controlled valve 28 to close at 70 (FIG. 4D). At this point, refrigerant contained within the expansion tank 12 is stored until the valve 28 is opened again.

After power has been applied to the refrigeration system 10 at 66 (FIG. 4A), the system 10 begins to cool down to its operating point. During this time, the relay control 62, which may comprise a microprocessor or other controller coupled to a relay driver by way of example, continuously or intermittently monitors the temperature sensed by the temperature probe 64. The relay contacts of the relay 60 remain closed, as indicated at 72 (FIG. 4C), until the relay control 62 determines that the cabinet (not shown) or other portion of the refrigeration system 10 has reached a predetermined temperature as sensed by the temperature probe 64. As indicated at 74 (FIG. 4),a the solenoid-controlled valve 28 remains closed as long as the relay contacts of the relay 60 remain closed as indicated at 72 (FIG. 4C).

When the relay control 62 determines that the cabinet (not shown) or other portion of the refrigeration system 10 has reached a predetermined temperature as sensed by the temperature probe 64, as indicated at 76 (FIG. 4B), the relay control 62 causes the relay 60 to open its relay contacts as indicated at 78 (FIG. 4C) which causes the solenoid-controlled valve 28 to open as indicated at 80 (FIG. 40). At this point, the refrigeration system 10 is operating preferably at or near, or at least approaching, its operating point and refrigerant stored in the expansion tank 12 is now permitted to pass from the expansion tank 12, through the valve 28 and capillary tube expansion device 30, to the suction line 22 to thereby provide additional cooling capacity to the system 10.

Further referring to FIGS. 1 and 4A–4D, when the refrigeration system 10 is turned off at 82 (FIG. 4A), the relay contacts of relay 60 remain open as indicated at 84 (FIG. 4C), and the solenoid-controlled valve 28 remains open as well as indicated at 86 (FIG. 4D). In this way, refrigerant is permitted to pass from the suction line 22 back to the expansion tank 12 so that when the valve 28 is closed, as indicated at 88 (FIG. 40), a predetermined amount of the refrigerant is stored in the expansion tank 12 and ready to be added again to the suction line 22 of system 10. The valve 28 closes at 88 (FIG. 4D) when the refrigeration system 10 is turned on again at 90 (FIG. 4A) which causes the relay contacts of the relay 60 to close at 92 (FIG. 4C) until the predetermined temperature condition is met again and the cycle repeats as described in detail above.

Figure 2:
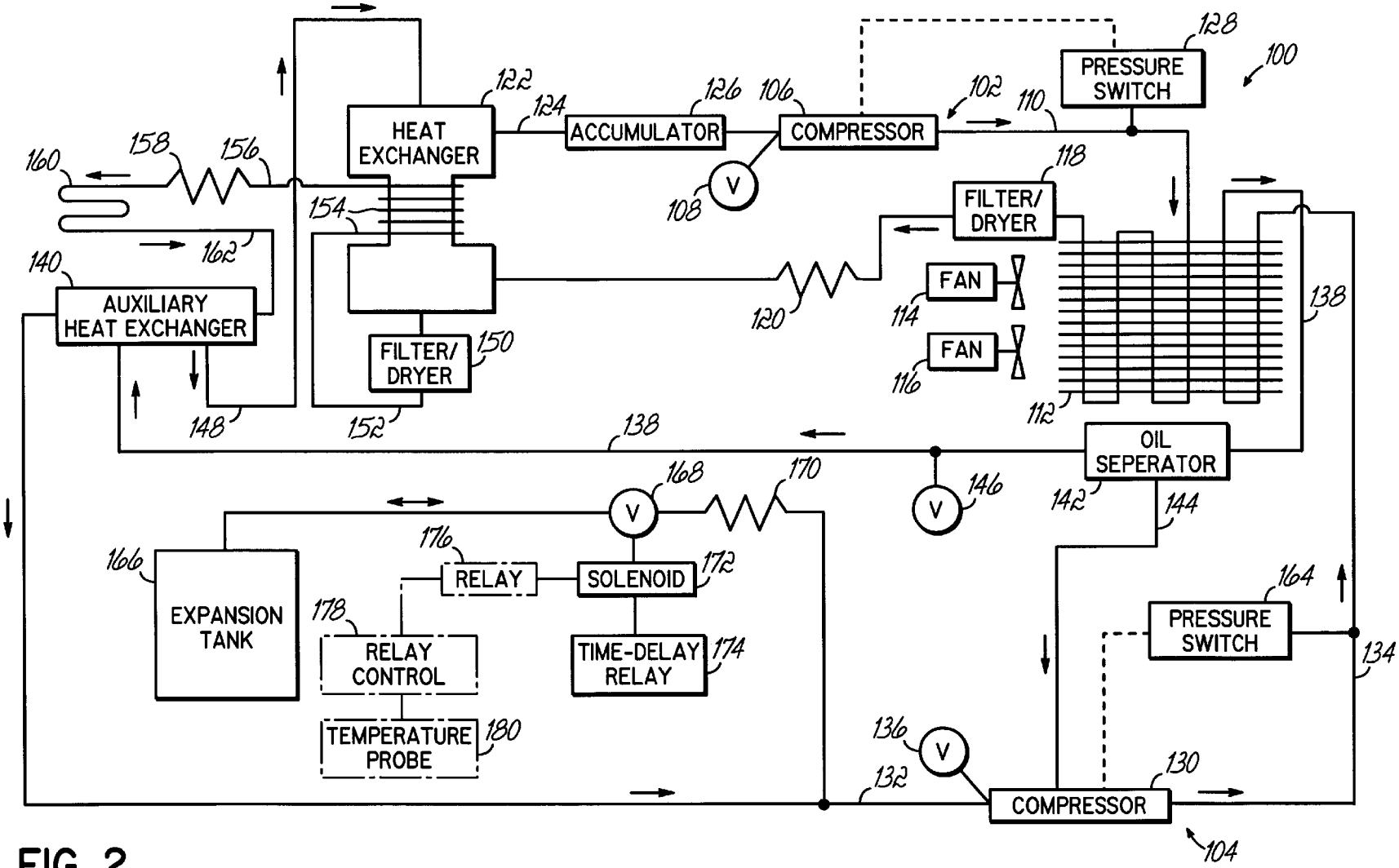
FIG. 2 is a block diagram of a two stage cascade refrigeration system incorporating the refrigerant expansion tank of the present invention for varying the refrigerant charge in the two stage system.

FIG. 2 is a block diagram of the preferred manner of incorporating the present invention into a two stage cascade refrigeration system 100. Specifically, system 100 includes a high temperature stage portion 102 and a low temperature stage portion 104. Such a two stage system is useful in freezer units designed for ultra low temperature applications, e.g., those applications requiring temperatures to be maintained in a range of about −50° C. to about −90° C. In this regard, the high temperature stage portion 102 and the low temperature stage portion 104 operate simultaneously so that the high temperature stage portion 102 functions primarily to exhaust heat from the system 100 and cool standard refrigeration or heat exchange components of the system 100, while the low temperature stage portion 104 functions primarily to cool the freezer's cabinet (not shown) or other intended refrigerated space. These two stage systems are generally known in the art and therefore the following detailed description focuses mainly on the inclusion of the refrigerant expansion tank components of the present invention in system 100 and certain conventional components, such as vibration isolation coils, oil separators, strainers, etc., which may normally be contained in two stage cascade refrigeration systems, have been left off FIG. 2 for clarity.

High temperature stage portion 102 of refrigeration system 100 comprises a high stage compressor 106, having a standard suction service valve 108 connected to its inlet, that discharges high pressure, high stage refrigerant, such as R-404A refrigerant, into high pressure line 110. High pressure line 110 leads to air cooled condenser 112 which removes heat by convection using a conventional finned surface and air from electric fans 114, 116. The condenser 112 discharges liquid refrigerant under pressure through filter-dryer 118 and into the inlet of a capillary tube expansion device 120. Capillary tube 120 then discharges low pressure liquid refrigerant into an interstage heat exchanger 122 which, in the high temperature stage portion 102 of system 100, acts as an evaporator. Interstage heat exchanger 122 discharges low pressure refrigerant into suction line 124 and accumulator 126 from which compressor 106 draws refrigerant to again cycle through the high temperature stage portion 102 of system 100.

A pressure switch 128 is disposed in the high pressure line 110 between compressor 106 and condenser 112. Pressure switch 128 serves as a precautionary measure to prevent over-pressurization of high temperature stage portion 102. Pressure switch 128 shuts down the high stage compressor 106 if a predetermined unsafe pressure is reached in high pressure line 110. This predetermined pressure limit may, for example, be about 375 psig.

Low temperature stage portion 104 is generally comprised of a low stage compressor 130 which draws low stage refrigerant, such as R-508B refrigerant, from suction line 132, compresses the refrigerant, and discharges it as a high pressure refrigerant into discharge line 134. The low stage compressor 130 preferably includes a conventional suction service valve 136 connected to an inlet side thereof. Compressor discharge line 134 leads to air cooled condenser 112 which functions as both the condenser for high temperature stage portion 102 and a desuperheating condenser for low stage refrigerant directed under pressure into high pressure line 138. High pressure refrigerant line 138 leads from condenser 112 to an auxiliary heat exchanger 140, which may serve as a second, desuperheating condenser to further cool the low stage refrigerant which at this point in the system is still in a gas or vapor phase. Line 138 includes an oil separator 142 to remove refrigerant oil from the low stage refrigerant. Oil return line 144 provides a fluid connection for oil to be transferred back to the compressor 130 when a sufficient amount has been collected. High pressure refrigerant line 138 may also include an access or service valve 146 as is conventional. A discharge line 148 takes the low stage refrigerant from auxiliary heat exchanger 140 through heat exchanger 122 which serves as the main condenser for low temperature stage portion 104. The low stage refrigerant passes through filter-dryer 150, and through lines 152, 154 and 156 to a low stage capillary tube expansion device 158.

In the embodiment shown in FIG. 2, lines 154 and 156 actually comprise one long capillary tube and form part of capillary tube expansion device 158. From capillary tube expansion device 158, the low stage refrigerant expands in an evaporator 160 and, by the way of line 162, is directed back through auxiliary heat exchanger 140, which preferably serves as a secondary evaporator in this section of the low temperature stage portion 104. Low stage refrigerant exits auxiliary heat exchanger 140 into suction line 132 and is again drawn into low stage compressor 130.

A pressure switch 164 is disposed in the discharge line 134 between compressor 130 and condenser 112. Pressure switch 164 serves as a precautionary measure to prevent over-pressurization of low temperature stage portion 104. Pressure switch 164 shuts down the low stage compressor 130 if a predetermined unsafe pressure is reached in discharge line 134. This predetermined pressure limit may, for example, be about 350 psig.

A refrigerant expansion tank 166, arranged essentially in accordance with refrigerant expansion tank system 12 of FIG. 1, is incorporated into the low temperature stage portion 104 of refrigeration system for varying the charge of refrigerant in the refrigerant fluid path of the low temperature stage portion 104. Expansion tank 166 adds additional refrigerant to the low temperature stage portion 104 of system 100 only after it has reached, is near, or at least is approaching, its operating point, which may be in a range of about −50° C. to about −90° C. The additional refrigerant is removed from the fluid path of the low temperature stage portion 104 and contained within the expansion tank 166 when the refrigeration system 100 is turned off.

Further referring to FIG. 2, expansion tank 166 is connected to the suction line 132 through a valve 168 and an expansion device, such as a capillary tube expansion device 170. As in the embodiment of FIG. 1, valve 168 may be a solenoid-controlled valve and includes a normally-open solenoid 172 for controlling open and closed positions of the valve 168. When the valve 168 is open, a predetermined amount of refrigerant stored in the expansion tank 166 passes through the capillary tube expansion device 170 to the suction side of the compressor 130. The additional refrigerant provided by the expansion tank 166 increases the charge of refrigerant in the fluid path of the low temperature stage portion 104 of system 100 to thereby provide additional cooling capacity to the system 100. The valve 168 also permits the refrigerant to pass from the suction line 132 back to the expansion tank 166 so that when the valve 168 is closed, a predetermined amount of the refrigerant is stored in the expansion tank 166 and ready to be added again to the suction line 132 of system 100 to provide the additional cooling capacity.

In accordance with one aspect of the present invention, the solenoid 172 of valve 168 is controlled by a time-delay relay 174 according to the control scheme described in detail above in connection with FIGS. 3A–3C so that the expansion tank adds refrigerant to the suction line 132 only when the refrigeration system 10 is operating preferably at or near, or at least approaching, its operating point to thereby provide additional cooling capacity to the system 100. When the refrigeration system 100 is turned off, the relay contacts of time-delay relay 174 remain open and the solenoid-controlled valve 172 remains open as well so that refrigerant is permitted to pass from the suction line 132 back to the expansion tank 166 so that when the valve 172 is closed, a predetermined amount of the refrigerant is stored in the expansion tank 166 and ready to be added again to the suction line 132 of system 100 to provide the additional cooling capacity as described in detail above.

In accordance with another aspect of the present invention, the solenoid 172 of valve 168 is controlled by a relay 176 that is operatively coupled to a relay control 178 and a temperature probe 180 (all shown in phantom in FIG. 2). In this embodiment, the solenoid 172 of valve 168 is controlled according to the control scheme described in detail above in connection with FIGS. 4A–4D so that the expansion tank 166 adds refrigerant to the suction line 132 when the relay control 178 determines that the cabinet (not shown) or other portion of the refrigeration system 100 has reached a predetermined temperature as sensed by the temperature probe 180. At this point, the refrigeration system 100 is operating preferably at or near, or at least approaching, its operating point and refrigerant stored in the expansion tank 166 is now permitted to pass from the expansion tank 166, through the valve 168 and capillary tube expansion device 170, to the suction line 132 to thereby provide additional cooling capacity to the system 100. The valve 168 also permits refrigerant to pass from the suction line 132 back to the expansion tank 166 so that when the valve 168 is closed, a predetermined amount of the refrigerant is stored in the expansion tank 166 and ready to be added again to the suction line 132 of system 100 to provide the additional cooling capacity as described in detail above.

It will be appreciated that the refrigerant expansion tanks 12, 166 vary the charge of refrigerant in systems 10, 100, respectively, to provide additional cooling capacity to the systems 10, 100 when each has reached, is near, or at least is approaching, its operating point. In this way, the operating constraints of the compressors 14, 130 that occur at elevated temperatures of the respective systems 10, 100 are no longer present, and the compressors 14, 130 are therefore capable of handling the additional refrigerant at the lower temperatures of the systems 10, 100 to provide the additional cooling capacity. The additional refrigerant is removed from the fluid path and contained within the expansion tanks 12, 166 when the refrigeration systems 10, 100 are turned off, and is ready to be added again to the suction lines 22, 132 of respective systems 10, 100 to provide the additional cooling capacity in accordance with the principles of the present invention.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

I claim:

1. A refrigeration system having a fluid flow path for a refrigerant, comprising:

a compressor in the fluid path having a suction side for receiving low pressure refrigerant and a discharge side for discharging high pressure refrigerant;

a condenser in the fluid path connected to the discharge side of the compressor for receiving the high pressure refrigerant from the compressor and condensing the high pressure refrigerant to produce a high pressure liquid refrigerant;

an expansion device in the fluid path connected to the condenser for receiving the high pressure liquid refrigerant from the condenser and expanding the high pressure liquid refrigerant to produce a low pressure liquid refrigerant;

an evaporator in the fluid path connected to the expansion device for receiving the low pressure liquid refrigerant from the expansion device and evaporating the low pressure liquid refrigerant to produce a low pressure gaseous refrigerant that is delivered to the suction side of the compressor;

an expansion tank connected to the fluid path at the suction side of the compressor for adding refrigerant to and removing refrigerant from the fluid path at the suction side of the compressor;

a valve fluidly connecting the expansion tank to the suction side of the compressor;

a valve control operatively connected to the valve and being operable to open the valve to provide fluid communication between the expansion tank and the fluid path at the suction side of the compressor, and further being operable to close the valve to retain refrigerant within the expansion tank; and an expansion device fluidly connecting the expansion tank to the suction side of the compressor.

2. The refrigeration system of claim 1 wherein the valve comprises a solenoid-controlled valve and the valve control comprises a time-delay relay operable to open the valve after a predetermined duration of time.

3. The refrigeration system of claim 1 wherein the valve comprises a solenoid-controlled valve and the valve control comprises a temperature probe coupled to a relay control of a relay, wherein the relay is operable to open the valve when a portion of the refrigeration system reaches a predetermined temperature as sensed by the temperature probe.

4. The refrigeration system of claim 1 wherein the expansion device comprises a capillary tube.

5. The refrigeration system of claim 1 wherein said system is a two stage system having both a high temperature stage portion and a low temperature stage portion, the expansion tank being part of the low temperature stage portion.

6. A method of varying refrigerant charge in a fluid flow path of a refrigeration system, comprising:

applying power to the refrigeration system; and adding refrigerant to the fluid flow path a predetermined duration of time after the power is applied to the refrigeration system.

7. A method of varying refrigerant charge in a fluid flow path of a refrigeration system, comprising:

cooling a portion of the refrigeration system;

sensing a temperature of the refrigeration system portion; and adding refrigerant to the fluid flow path when the sensed temperature of the refrigerant system portion reaches a predetermined temperature.

8. A refrigeration system having a fluid flow path for a refrigerant, comprising:

a compressor in the fluid path having a suction side for receiving low pressure refrigerant and a discharge side for discharging high pressure refrigerant;

a condenser in the fluid path connected to the discharge side of the compressor for receiving the high pressure refrigerant from the compressor and condensing the high pressure refrigerant to produce a high pressure liquid refrigerant;

an expansion device in the fluid path connected to the condenser for receiving the high pressure liquid refrigerant from the condenser and expanding the high pressure liquid refrigerant to produce a low pressure liquid refrigerant;

an evaporator in the fluid path connected to the expansion device for receiving the low pressure liquid refrigerant from the expansion device and evaporating the low pressure liquid refrigerant to produce a low pressure gaseous refrigerant that is delivered to the suction side of the compressor; and an expansion tank connected to the fluid path at the suction side of the compressor for adding refrigerant to and removing refrigerant from the fluid path at the suction side of the compressor;

a valve fluidly connecting the expansion tank to the suction side of the compressor; and a valve control operatively connected to the valve and being operable to open the valve to provide fluid communication between the expansion tank and the fluid path at the suction side of the compressor and to close the valve to retain refrigerant within the expansion tank;

wherein the valve comprises a solenoid-controlled valve and the valve control comprises a time-delay relay operable to open the valve after a predetermined duration of time.

9. The refrigeration system of claim 8 wherein said system is a two stage system having both a high temperature stage portion and a low temperature stage portion, the expansion tank being part of the low temperature stage portion.

10. A refrigeration system having a fluid flow path for a refrigerant, comprising:

a compressor in the fluid path having a suction side for receiving low pressure refrigerant and a discharge side for discharging high pressure refrigerant;

a condenser in the fluid path connected to the discharge side of the compressor for receiving the high pressure refrigerant from the compressor and condensing the high pressure refrigerant to produce a high pressure liquid refrigerant;

an expansion device in the fluid path connected to the condenser for receiving the high pressure liquid refrigerant from the condenser and expanding the high pressure liquid refrigerant to produce a low pressure liquid refrigerant;

an evaporator in the fluid path connected to the expansion device for receiving the low pressure liquid refrigerant from the expansion device and evaporating the low pressure liquid refrigerant to produce a low pressure gaseous refrigerant that is delivered to the suction side of the compressor; and an expansion tank connected to the fluid path at the suction side of the compressor for adding refrigerant to and removing refrigerant from the fluid path at the suction side of the compressor;

a valve fluidly connecting the expansion tank to the suction side of the compressor; and a valve control operatively connected to the valve and being operable to open the valve to provide fluid communication between the expansion tank and the fluid path at the suction side of the compressor and to close the valve to retain refrigerant within the expansion tank;

wherein the valve comprises a solenoid-controlled valve and the valve control comprises a temperature probe coupled to a relay control of a relay, wherein the relay is operable to open the valve when a portion of the refrigeration system reaches a predetermined temperature as sensed by the temperature probe.

11. The refrigeration system of claim 10 wherein said system is a two stage system having both a high temperature stage portion and a low temperature stage portion, the expansion tank being part of the low temperature stage portion.

12. A refrigeration system having a fluid flow path for a refrigerant, comprising:

a compressor in the fluid path having a suction side for receiving low pressure refrigerant and a discharge side for discharging high pressure refrigerant;

a condenser in the fluid path connected to the discharge side of the compressor for receiving the high pressure refrigerant from the compressor and condensing the high pressure refrigerant to produce a high pressure liquid refrigerant;

an expansion device in the fluid path connected to the condenser for receiving the high pressure liquid refrigerant from the condenser and expanding the high pressure liquid refrigerant to produce a low pressure liquid refrigerant;

an evaporator in the fluid path connected to the expansion device for receiving the low pressure liquid refrigerant from the expansion device and evaporating the low pressure liquid refrigerant to produce a low pressure gaseous refrigerant that is delivered to the suction side of the compressor;

an expansion tank connected to the fluid path at the suction side of the compressor for adding refrigerant to and removing refrigerant from the fluid path at the suction side of the compressor; and an expansion device fluidly connecting the expansion tank to the suction side of the compressor.

13. The refrigeration system of claim 12 wherein the expansion device comprises a capillary tube.

14. The refrigeration system of claim 12 wherein said system is a two stage system having both a high temperature stage portion and a low temperature stage portion, the expansion tank being part of the low temperature stage portion.

* * * * *